US010392778B2

(12) United States Patent
Hernandez

(10) Patent No.: US 10,392,778 B2
(45) Date of Patent: Aug. 27, 2019

(54) STABILIZING SYSTEM FOR EXCAVATORS

(71) Applicant: MIME, LLC, Brighton, CO (US)

(72) Inventor: Ruben D. Hernandez, Brighton, CO (US)

(73) Assignee: MIME, LLC, Brighton, CO (US)

( * ) Notice: Subject to any disclaimer, the term of this patent is extended or adjusted under 35 U.S.C. 154(b) by 243 days.

(21) Appl. No.: 15/463,621

(22) Filed: Mar. 20, 2017

(65) Prior Publication Data

US 2017/0275850 A1 Sep. 28, 2017

Related U.S. Application Data

(60) Provisional application No. 62/313,280, filed on Mar. 25, 2016.

(51) Int. Cl.

| | |
|---|---|
| ***E02F 9/08*** | (2006.01) |
| ***E02F 3/32*** | (2006.01) |
| ***E02F 9/02*** | (2006.01) |
| ***E02F 5/02*** | (2006.01) |

(52) U.S. Cl.

CPC ..... *E02F 9/085* (2013.01); *E02F 3/32* (2013.01); *E02F 5/025* (2013.01); *E02F 9/024* (2013.01)

(58) Field of Classification Search

CPC ... E02F 9/085; E02F 5/025; E02F 3/32; E02F 9/024

See application file for complete search history.

(56) References Cited

U.S. PATENT DOCUMENTS

| | | | | | |
|---|---|---|---|---|---|
| 2,914,127 | A * | 11/1959 | Ricouard | B62D 57/00 | 180/8.5 |
| 3,037,571 | A * | 6/1962 | Zelle | B62D 55/084 | 180/9.48 |
| 4,018,458 | A * | 4/1977 | Shumaker | E02F 9/085 | 212/304 |
| 4,548,528 | A * | 10/1985 | Bell | E02F 5/104 | 405/272 |
| 5,598,896 | A * | 2/1997 | Haest | B62D 55/084 | 180/9.48 |
| 10,087,595 | B2 * | 10/2018 | Williamson | E02D 17/08 | |

* cited by examiner

*Primary Examiner* — Paul N Dickson
*Assistant Examiner* — Joselynn Y Sliteris
(74) *Attorney, Agent, or Firm* — Trenner Law Firm, LLC; Mark D. Trenner

(57) ABSTRACT

A support system for an excavator is disclosed as it may include an extended center frame, a trench support, and/or a mat. The extended center frame may be bolted onto a standard excavator to widen the overall footprint of the machine and reduce ground pressure. The trench support relieves any remaining pressure toward the open trench. The extended center frame enables a larger excavator to straddle an open trench, while at the same time a smaller excavator can dig the shallower depths, thereby increasing efficiencies. By implementing the trench support and/or the mat, it might not be necessary to widen the tracks of the excavator as far, thus further reducing time-related costs. In addition, the trench support may also enhance safety of the trenching operations.

14 Claims, 18 Drawing Sheets

FIG. 10B
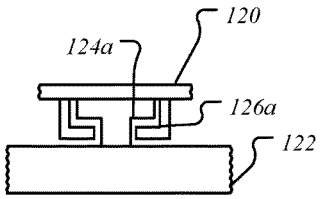
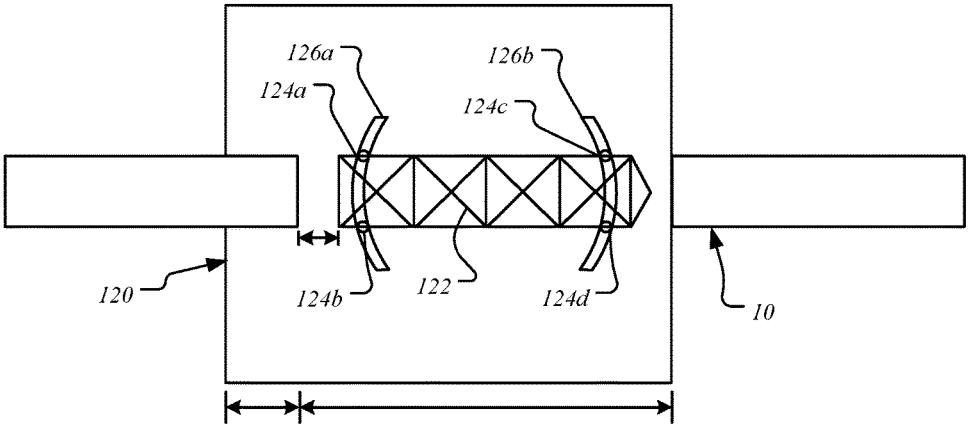
FIG. 10A

STABILIZING SYSTEM FOR EXCAVATORS

PRIORITY CLAIM

This application claims the priority benefit of U.S. Provisional Patent Application No. 62/313,280 filed Mar. 25, 2016 titled "Extended Center Frame For Excavators" of Ruben D. Hernandez, hereby incorporated by reference as though fully set forth herein.

BACKGROUND

Excavators used for digging slurry walls range in size from approximately 190,000 to 240,000 or more pounds. These Excavators are equipped with custom sticks and/or booms, to extend the digging depths from 50 feet to 90 feet or more.

When used to excavate slurry walls, the trenching excavator starts at the ground surface and digs to the required depths per engineer requirements. The operating cost of the machine is the same when digging at shallow depths and at the maximum depths. But typically, there is no way around using a larger, more expensive excavator (e.g., costing $50,000 to $80,000 or more per month) to dig both the shallow and deeper depths, even though a less expensive machine could handle the shallower depths. That is, the contractor often has to start the job with a machine capable of digging to the maximum required depths on the plans/design because it is not cost effective to have the larger excavator move out of the way to allow a smaller machine to dig first. In addition, the larger machine would just sit dormant while the smaller machine digs and vice versa. Therefore, this would simply increase the overall cost, for little if any increase in production efficiency (i.e., having just increased the cost for very little increase in production, if any).

However, larger excavators are difficult to operate with an open, continuous trench in slurry wall construction. Large excavators are cumbersome, and still risk collapsing the trench when straddling the trench trying to reset the mats on a new set. The larger machines cannot straddle the trench for very long to allow use of two machines working on the same heading. The excavators weigh too much and the distance between the tracks are too narrow (the trench might collapse).

Mats can be used, but the footprint is still small, and still risk collapsing the trench. In addition, moving mats take a long time, as sections of the mat need to be moved one at a time, while still having to support the excavator with other sections of the mats, which can be very time consuming. Thus, typically the only time contractors use mats are when they are working on unstable/soft soil.

BRIEF DESCRIPTION OF THE DRAWINGS

FIGS. 10A-B shows the excavator tracks attached to the mat of the stabilizing system.

DETAILED DESCRIPTION

There are two types of support equipment that are commonly used while digging a slurry wall, which are used for the backfill operations. First, an excavator (e.g., Komatsu PC 350 or the like); and second, a dozer (e.g., Komatsu D65, or Cat D6-8 dozer, or the like). There are also multiple pumps, pipe, de-sanding machines, fork lifts, storage units, etc., that are utilized for digging slurry walls. When production is very slow due to extreme depths, the support equipment can sit dormant a considerable amount of time. That is, the support equipment cannot backfill until the trenching excavator is far enough ahead of the toe of the backfill slope. Everything is at a standstill or at a very slow pace, waiting for the larger excavator to finish a set.

Figure 1:
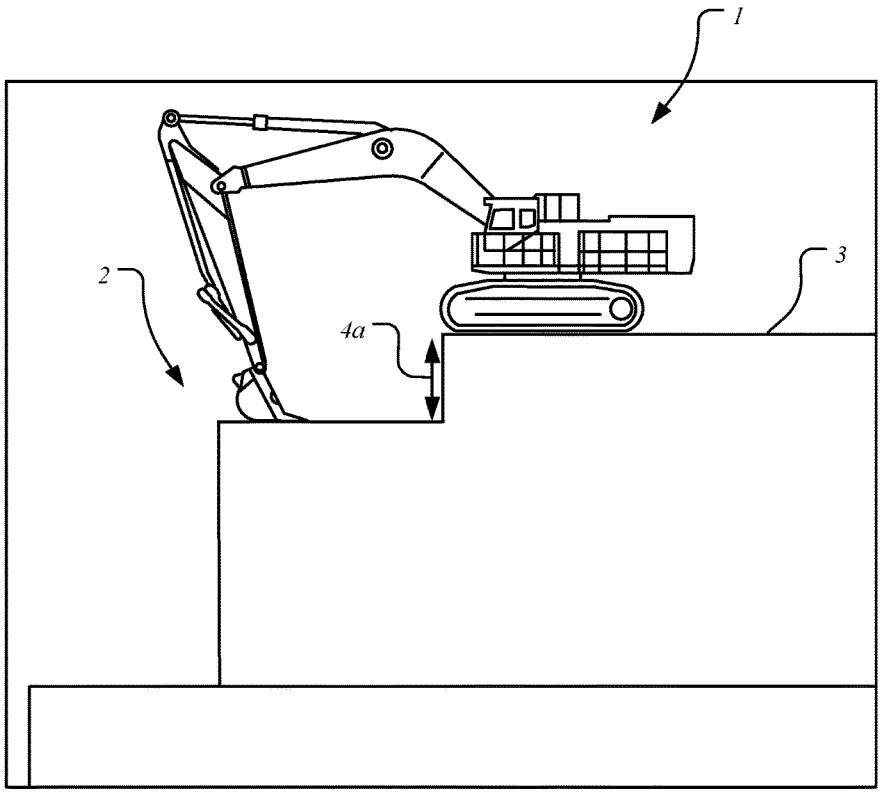
FIGS. 1-2 show an excavator digging a trench.
Figure 2:
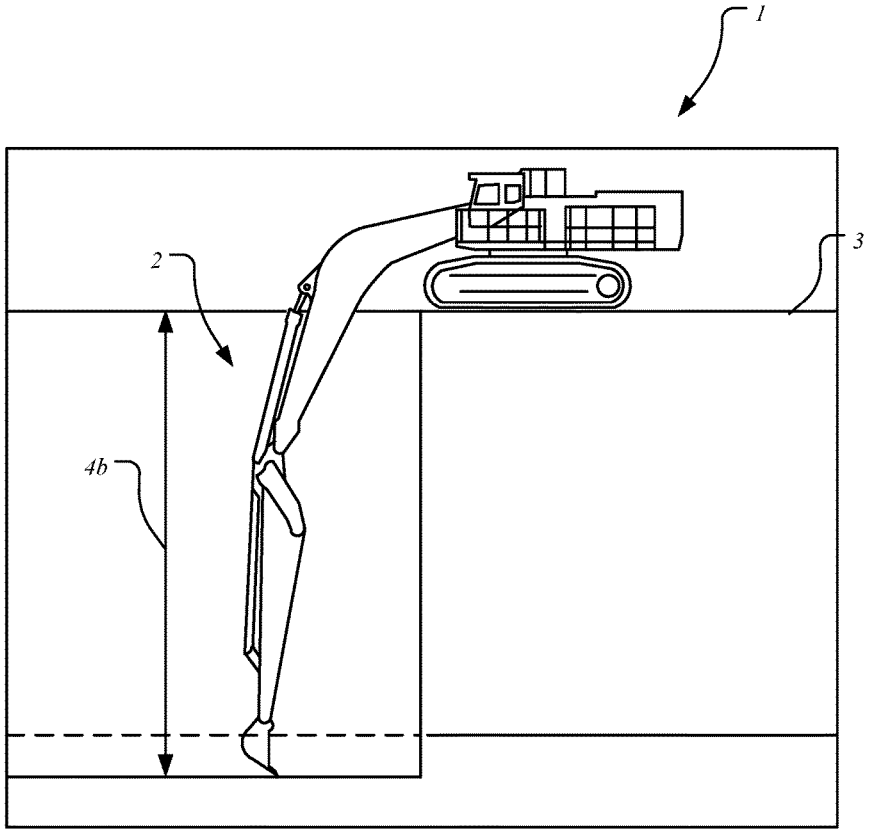

There has not been a way to utilize two excavators on the same heading in an open trench slurry wall 2. That is, a large excavator 1 had to dig from the surface 3 at varying depths 4*a* as shown in FIG. 1, down to full depth 4*b* as shown in FIG. 2. This can be very expensive. The deeper the full depth 4*b*, the slower the production.

Contractors still have to maintain all of the support equipment and personnel, but they are utilized based on the production rate of the trenching excavator. If the job has very tight time constraints, the contractor has to mobilize two of every type of equipment and dig two separate headings.

By way of illustration, a contractor may have a very stringent time constraint where a project has to be completed by the end of the year; before the cold weather arrived. It is difficult to dig slurry walls in freezing temperatures, because of the high percentage of moisture in the spoils and backfill. Part of the wall depths are in the range of 40 to 60 feet. A PC 800 Komatsu or the like can be utilized, with a custom boom and stick. But maximum digging depths are about 60 feet. The other approximately 40% of the wall depths are up to about 70 feet or more. A PC 1250 Komatsu or the like can be used, with a custom boom and stick with maximum digging depth of about 90 feet.

In this illustration, the contractor may mobilize two slurry wall crews, with two of everything. For example, the contractor may mobilize two small excavators and two dozers for backfilling at the two slurry wall headings. This requires two crews to man both operations, which also entails housing and meal allowances. This also requires two pumps to supply slurry to the different slurry wall headings, along with hundreds/thousands of feet of slurry pipe, two de-sanders, valves, and a host of smaller equipment/supplies. This is a big expense to incur at the start and end of a project, including the mobilization and de-mobilization of equipment, which approximately doubles the cost.

Figure 3A:
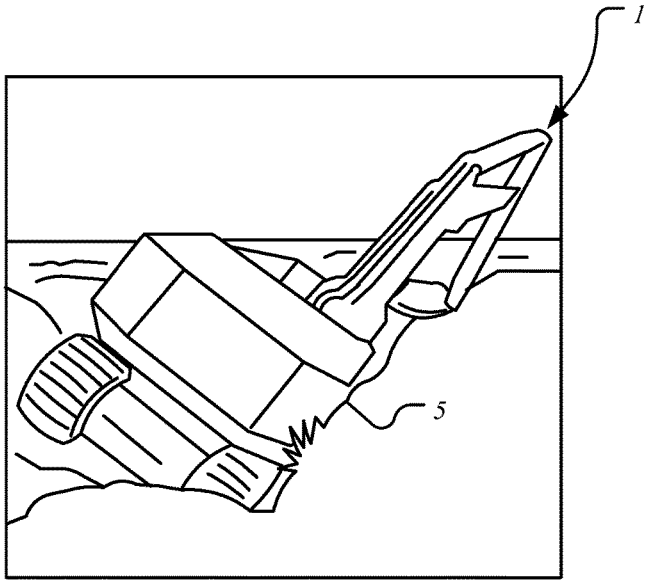
FIGS. 3A-B illustrate a trench collapse after an excavator attempted to straddle a trench.
Figure 3B:
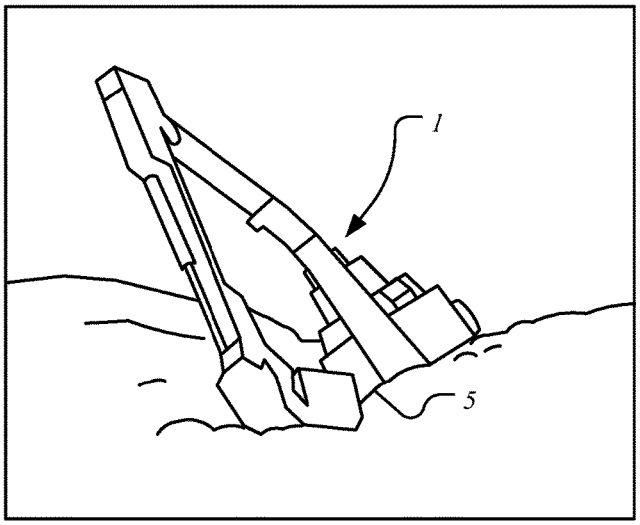

In addition, larger excavators 1 cannot straddle a trench 5 for very long to allow use of two excavators 1 working on the same heading. The excavators 1 weigh too much and the distance between the tracks are too narrow. Large excavators 1 are cumbersome, and risk collapsing the trench 5 when straddling the trench, as illustrated in FIGS. 3A and 3B.

A stabilizing system for excavators including an extended center frame, mat(s), and/or trench support(s) is disclosed herein. In an example, the extended center frame includes a frame component for mounting between opposing tracks of the excavator and a base portion of the excavator. The frame component extends beyond the base portion of the excavator on both sides to move the opposing tracks apart from one another relative to the opposing tracks being mounted to the base portion.

A lift may be provided to raise and lower the mat below the excavator so that the mat stays with the excavator when the excavator moves.

Both the extended center frame and the mat(s) relieve pressure on the ground due to weight of the excavator.

The trench support relieves any remaining pressure toward the open trench, and reduces or eliminates the sidewalls from caving in. By implementing the trench support, it might not be necessary to widen the tracks of the excavator as far, thus further reducing time-related costs. In addition, the trench support may also enhance safety of the trenching operations.

Before continuing, it is noted that as used herein, the terms "includes" and "including" mean, but is not limited to, "includes" or "including" and "includes at least" or "including at least." The term "based on" means "based on" and "based at least in part on."

Figure 4:
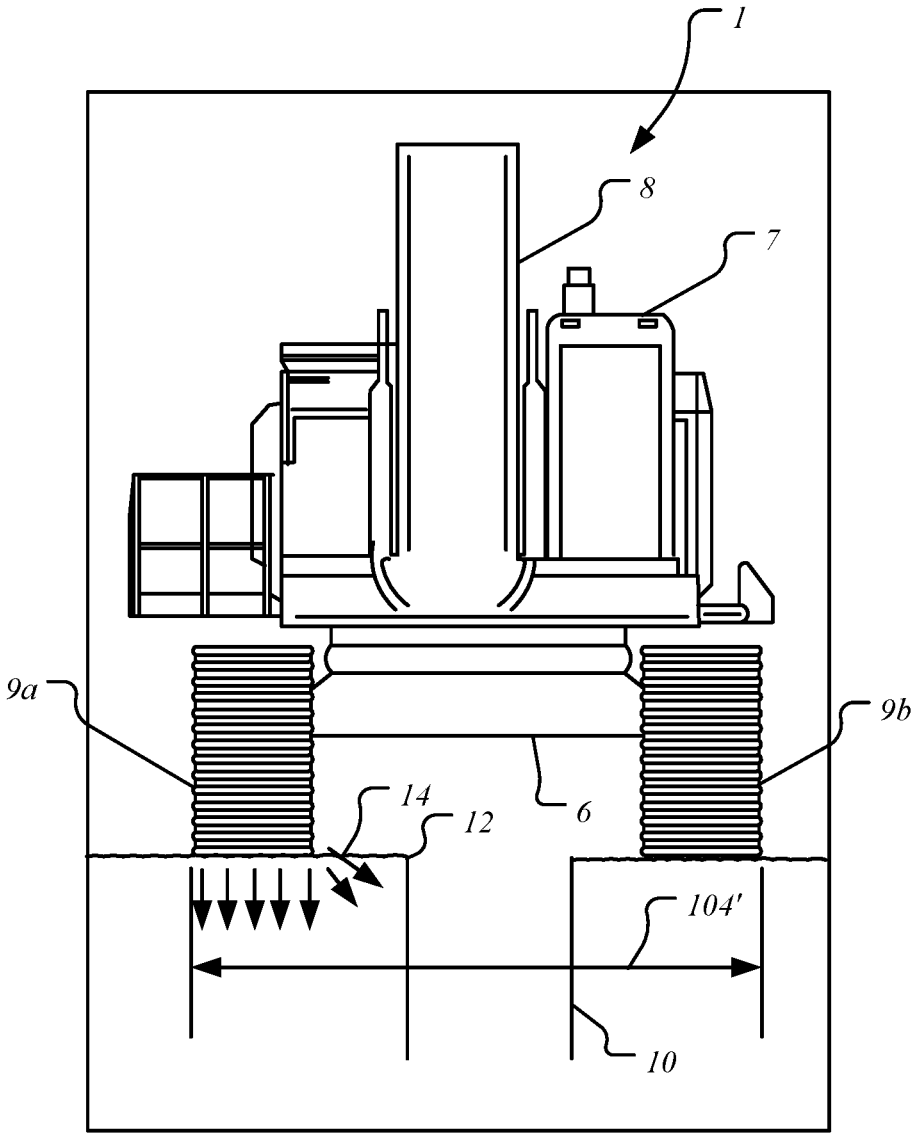
FIG. 4 is a diagram of an excavator which may implement the stabilizing system described herein.

FIG. 4 is a diagram of an excavator 1 which may implement the stabilizing system 101 disclosed herein. In an example, the excavator 1 may include a base portion 6. The base portion 6 supports a cab 7 for the operator, and a trenching arm or crane 8 of the excavator 1. The excavator 1 also includes opposing tracks 9*a* and 9*b*.

Figure 5A:
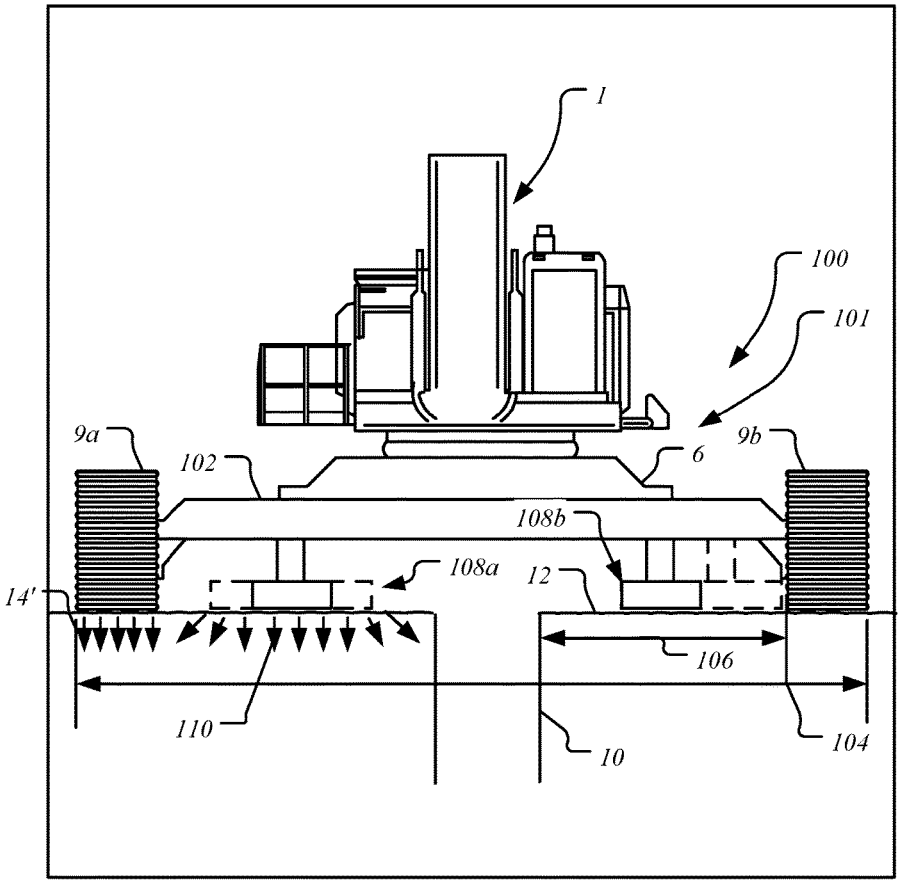
FIG. 5A is a diagram of an excavator configured with an example extended center frame of the stabilizing system.
Figure 5B:
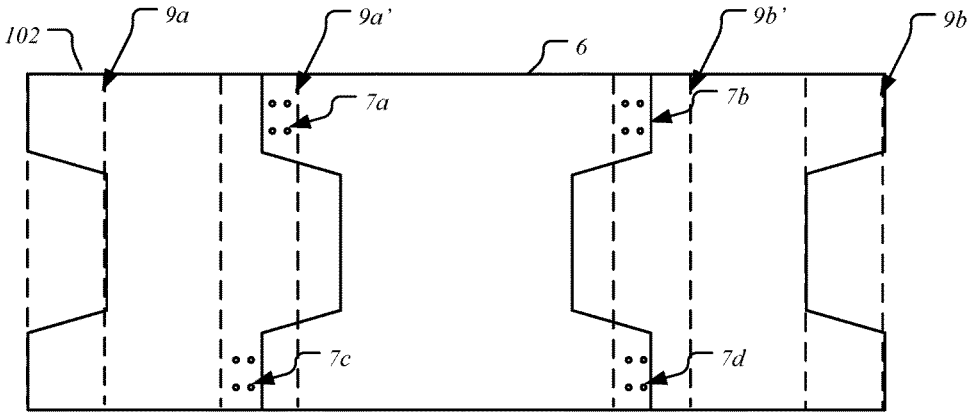
FIG. 5B is a top view diagram of an excavator configured with an example extended center frame of the stabilizing system.

The trenching arm 8 of the excavator 1 can be operated (e.g., by an operator in the cab 7) to dig a trench 10 in the ground 12. As the trench 10 is dug deeper into the ground, pressure from the weight of the excavator 1 is applied both in a downward direction and toward the trench 10, as indicated by arrows 14. This pressure may cause the trench to collapse, thus destabilizing the ground that the excavator is sitting on. Depending on the extent of this destabilizing of the ground, the excavator may fall over, e.g., as illustrated in FIGS. 3A and 3B described above. The extended center frame 100 disclosed herein may reduce or altogether prevent this from occurring FIG. 5A is a diagram of an excavator configured with an example extended center frame 100 of the stabilizing system 101. The center frame 100 may include a frame component 102 may be mounted between the opposing tracks 9*a* and 9*b* of the excavator 1 and a base portion 6 of the excavator 1. The frame component 102 extends beyond the base portion 6 of the excavator 1 on both sides, as can be seen in the top view shown in FIG. 5B. As such, the frame component 102 is configured to separate or move the opposing tracks 9*a* and 9*b* apart (see prior location at 9*a*' and 9*b*' in FIG. 5B) from one another relative to the opposing tracks being mounted to the base portion (e.g., compare FIG. 4 to FIGS. 5*a*-B).

In an example, the frame component 102 of the center frame 100 is bolted (or otherwise attached, e.g., at 7*a*-*d*) onto the base portion 6 of the excavator 1. For example, the frame component 102 may be bolted onto the base portion 6 where the opposing tracks 9*a* and 9*b* are attached, so that no modification to the excavator 1 is necessary. The frame component 102 may also be bolted onto the track frame of the opposing tracks 9*a* and 9*b*, again using existing bolt holes and requiring no modification to the excavator 1 itself. This may be particularly advantageous, for example, where the excavator is rented and cannot be modified by drilling new holes. This also maintains the structural integrity of the original equipment.

For purposes of illustration, the extended center frame 100 can be bolted onto standard excavators (e.g., 190,000-240,000 pound or higher; or smaller machines that have bolted on tracks). This configuration widens the overall footprint of the excavator 1, and reduces the overall ground pressure. There is no need to make permanent modifications to the excavator 1, thus allowing the extended center frame 100 to be installed on a rented machine.

The frame component 102 widens a footprint 104 of the excavator 1. In an example, the frame component 102 provides a width 104 or "footprint" of about 16 to 28 feet (although any suitable footprint may be achieved based on the size of the frame component 102). By way of illustration, compare the footprint 104' of the excavator 1 shown in FIG. 4 with the footprint 104 of the excavator 1 configured with the extended center frame 100 shown in FIG. 5. This distance 106 from the tracks 9*a* and 9*b* also serves to move ground pressure (illustrated by arrows 14') away from the trench 10, thereby reducing or eliminating collapse of the trench 10.

In an example, the extended center frame 100 may also include one or more stabilizer 108*a* and 108*b*. The stabilizer(s) 108*a* and 108*b* may be extended from the excavator 1 to further reduce ground pressure, e.g., as indicated by relieving some of the pressure 14' at the stabilizers 108*a* and 108*b*, as illustrated by arrows 110.

Figure 6A:
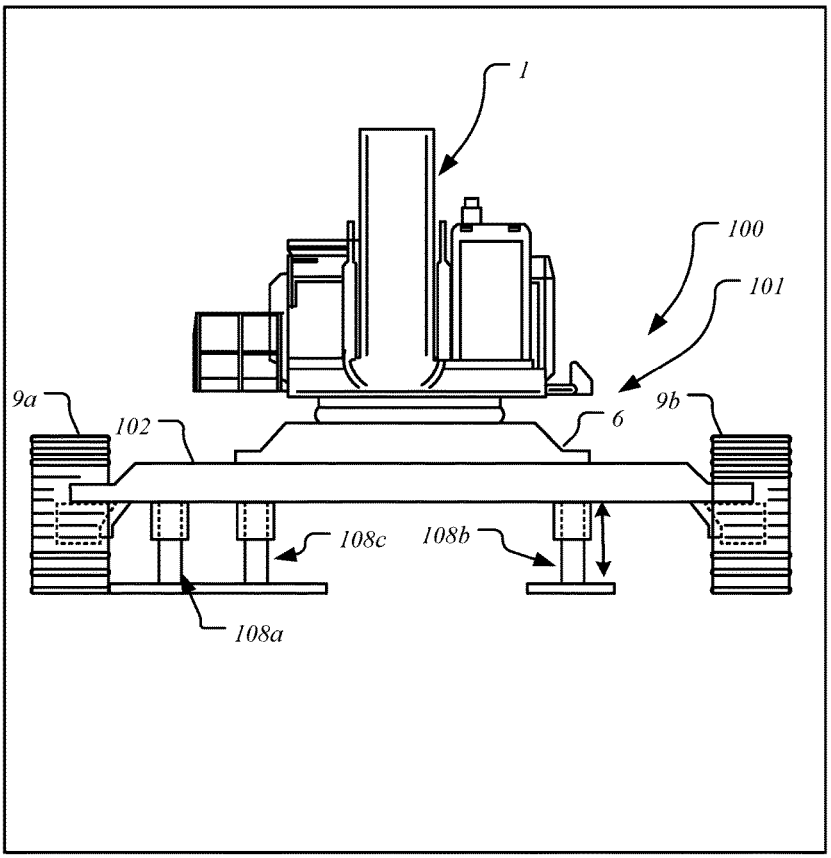
FIG. 6A is another diagram of an excavator configured with an example extended center frame of the stabilizing system.

It is noted that the stabilizers 108*a* and 108*b* may be any desired width, as indicated in the drawings by the dashed lines. In addition, more than one stabilizer may be provided on each side, e.g., as shown in FIG. 6A. FIG. 6A is another diagram of an excavator configured with an example extended center frame 100. In FIG. 6A, two stabilizers 108*a* and 108*c* are both shown on the one side. Two or more stabilizers may also be provided on the opposite side. In addition, the stabilizers 108*a* and 108*c* may include the same or separate base portions 112. When the excavator 1 is digging, the extended center frame 102 may only flex a few inches, before the stabilizing supports 108 make contact with the ground 12. The bottom of the stabilizing supports 108 can be left inches off the ground 12, to allow the excavator 1 to travel freely.

Figure 6B:
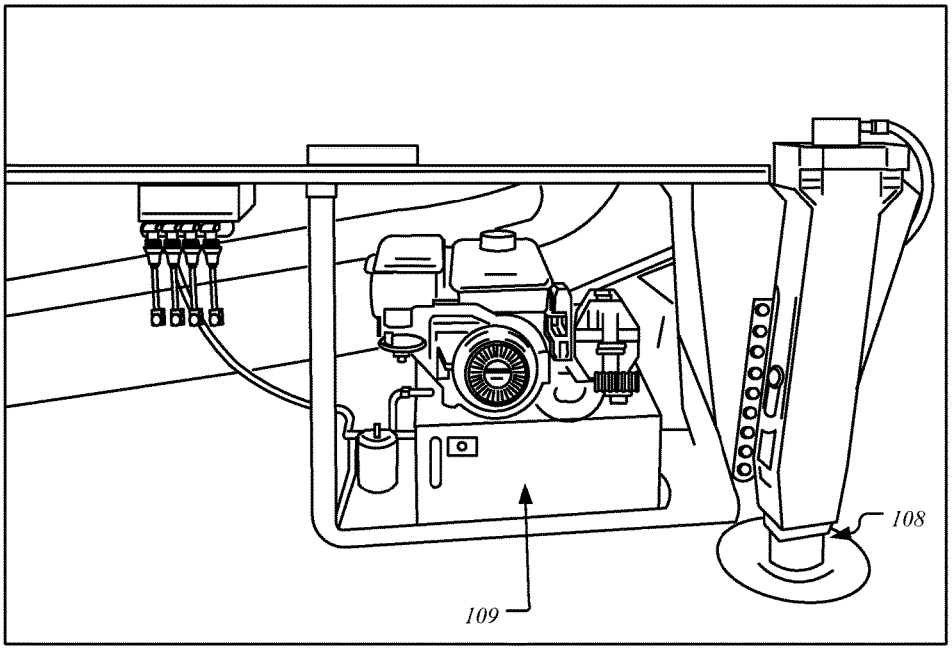
FIG. 6B shows an example actuator for a stabilizer.

FIG. 6B shows an example actuator 109 for a stabilizer 108. In an example, the actuator is engine driven. In an example, the stabilizer(s) can include hydraulic cylinders, operated by the excavator's hydraulic system, or a remote system permanently installed on the stabilizing system 101. Other options are available, such as but not limited to, electric or pneumatic ram cylinders that can be raised while the machines travels, and lowered when ready to dig. In other examples, a mechanical cylinder and/or a manual/adjustable ram can be provided to reduce the cost.

Figure 6C:
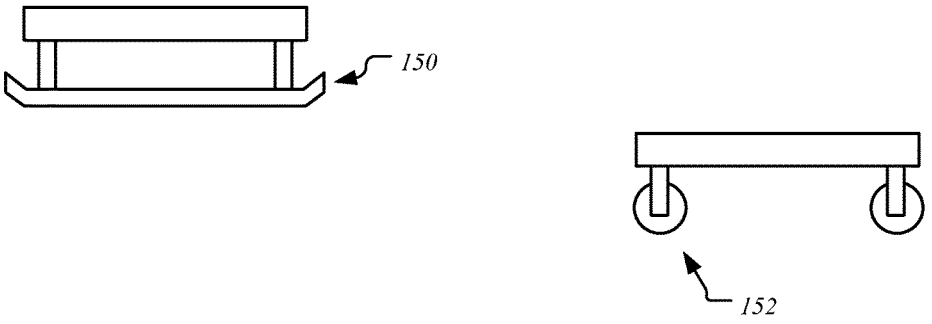
FIG. 6C shows examples of stabilizer configurations.

FIG. 6C shows examples of stabilizer 108 configurations. The stabilizer 108 may include non-moveable skids or pads 150; or movable tracks, rollers, or casters 152. The stabilizers 108 can be attached at various locations, to redistribute the weight of the excavator 1 to limit the ground pressure. This enables an excavator 1 to straddle a standard slurry wall trench (e.g., about 3 to 4 feet wide or more).

Figure 7:
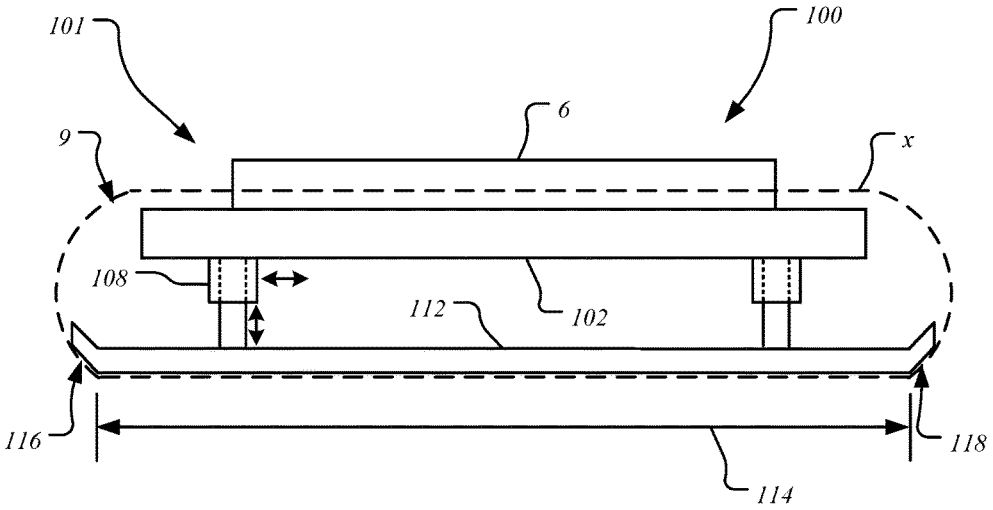
FIG. 7 is a side view of the extended center frame of the stabilizing system.

FIG. 7 is a side view of the extended center frame 100, showing one of the stabilizers 108. The stabilizer 108 may include at least one of a pad, roller, caster, track, and skid. In FIG. 7, the stabilizer is shown as it may include a pad or skid 112. However, other configurations will also be readily understood by those having ordinary skill in the art after becoming familiar with the teachings herein.

As shown in FIG. 7, the skid 112 of the stabilizer 108 extends substantially parallel to the length 114 of the track 9 of the excavator 1. In addition, the stabilizer 108 extends for substantially the same length 114 as the track 9 of the excavator 1. The stabilizer 108 has a first or front end 116. The front end 116 has a radius substantially the same as a radius of the track 9. The stabilizer 108 has a second or back end 118. The back end 118 has a radius substantially the same as a radius of the track 9. Again, the configuration shown in FIG. 7 is merely illustrative and not intended to be limiting.

Figure 8:
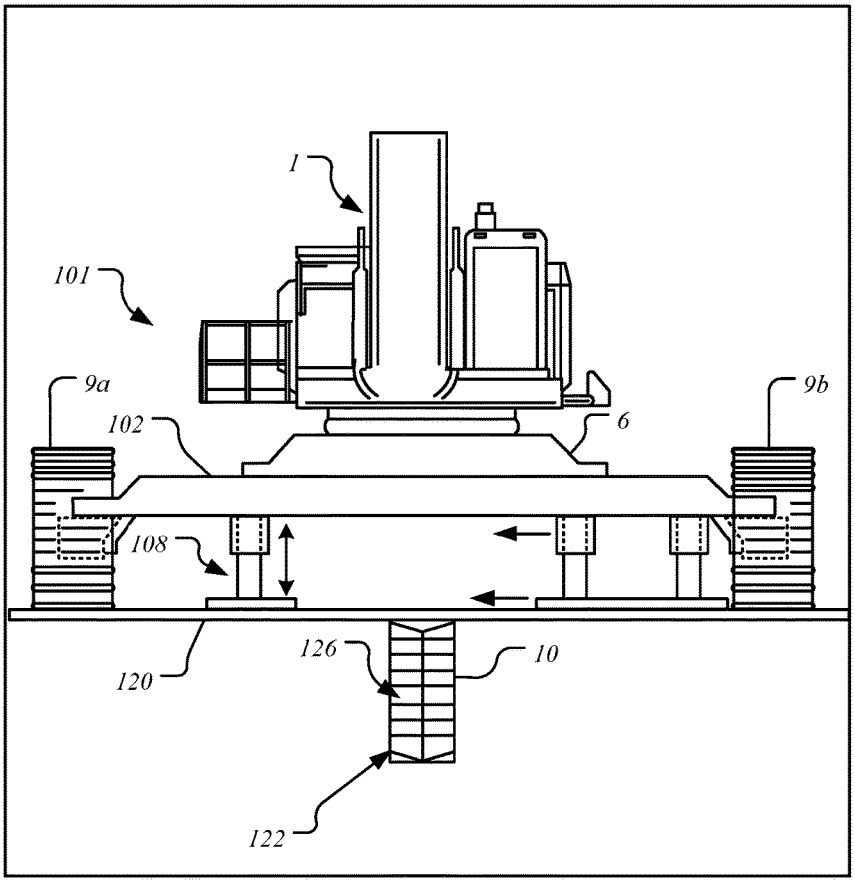
FIG. 8 is a front view of an example stabilizing system.
Figure 9:
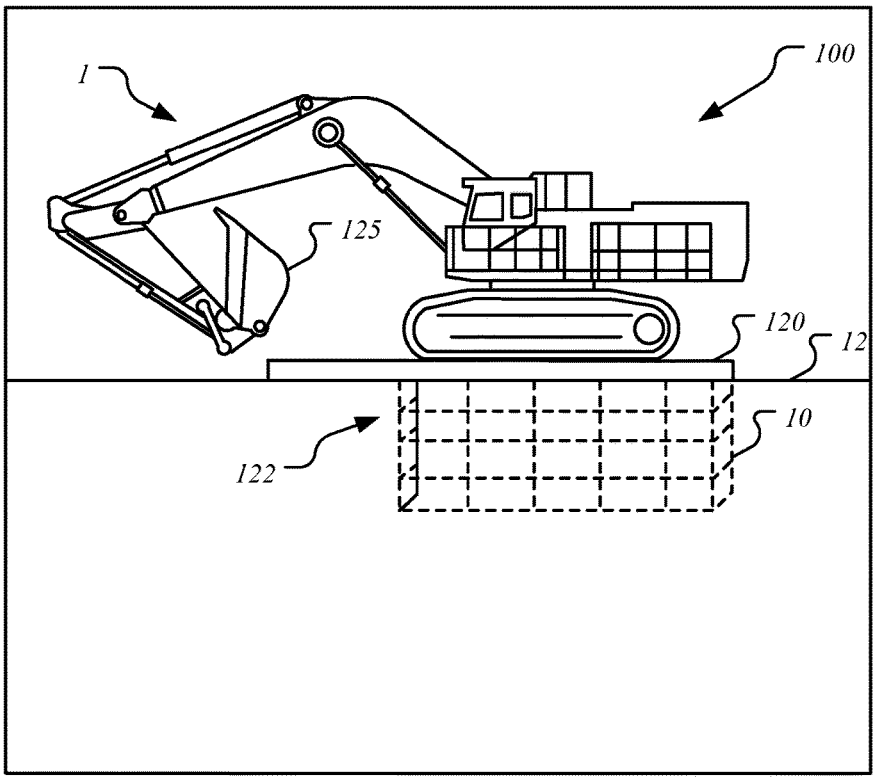
FIG. 9 is a side view of an excavator on an example mat of the stabilizing system.

FIG. 8 is a front view of an example stabilizing system 101. FIG. 9 is a side view of an excavator 1 on an example mat 120 of the stabilizing system 101. The trench support 122 is also shown in FIG. 9. FIGS. 10A-B show the trench support 122 attached to the mat 120.

In an example, the extended center frame 100, the mat 120, and the trench support 122 may be implemented in addition to, or instead of the other components of the stabilizing system. For example, the extended center frame 100 may be implemented by itself, or in combination with the mat 120 and/or the trench support 122. Likewise, the mat 120 may be implemented by itself, or in combination with the extended center frame 100 and/or the trench support 122. And the trench support 122 may be implemented by itself and/or in combination with the extended center frame 100 and/or the mat 120.

The mat 120 may be provided on the ground over the trench 10 that has already been dug, so that the excavator 1 can be moved onto the mat 120. The mat 120 may be implemented to spread pressure from the weight of the excavator 1 more evenly across the ground and reduce ground pressure. The stabilizer(s) 108 may be lowered onto the mat to further spread ground pressure from the excavator 1.

In an example, the mats 120 can be implemented on large excavators to redistribute the ground pressure. With the ability to straddle the trench, when the excavator 1 starts a new set, the mats 120 can be pulled into place. As such, lifting sections one at a time (because they were not able to straddle an open trench safety) is not necessary, saving time and money. In an example, the mats 120 can be about 4 to 6 inches thick In an example, the mat 120 is attached to at least one of the opposing tracks 9*a* and 9*b* of the excavator 1. The mat 120 may further be attached to the trench support 122 by at least one pin 124*a-d*, as illustrated in FIG. 10. The pin(s) 124*a-d* may be mounted in an arcuate channel 126*a* and 126*b*. The pins 124*a-b* may travel in channel 126*a* and the pins 125*c-d* may travel in channel 126*b*. This may enable the mat 120 to pivot or turn, so that the mat 120 can follow the path of the trench 10 being dug by the excavator 1.

The trench support 122 may be implemented in addition to, or instead of the mat 120. In an example, the trench support 122 is connected to the mat 120. As such, the trench support 122 stays substantially beneath the excavator 1, where it is needed. In addition, this configuration enables the trench support 122 to move with the mat 120 so that the trench support 122 does not need to be moved separately from the mat 120.

In an example, the trench support 122 forms a plurality of voids 126. These voids may be formed by the structure of the trench support 122. The voids and the structure provide structural integrity. In addition, the voids provide openings, e.g., for a slurry to pass through without having to remove the trench support 122.

The trench support 122 may be substantially the same width as a bucket 125 (FIG. 9) of the excavator 1 used to dig the trench 10. The structure of the trench support 122 provides support to the sidewalls of the trench 10 dug by the bucket 125 so as to maintain the sidewalls of the trench 10 and prevent the sidewalls of the trench 10 from collapsing under weight or pressure of the excavator 1.

Figure 11:
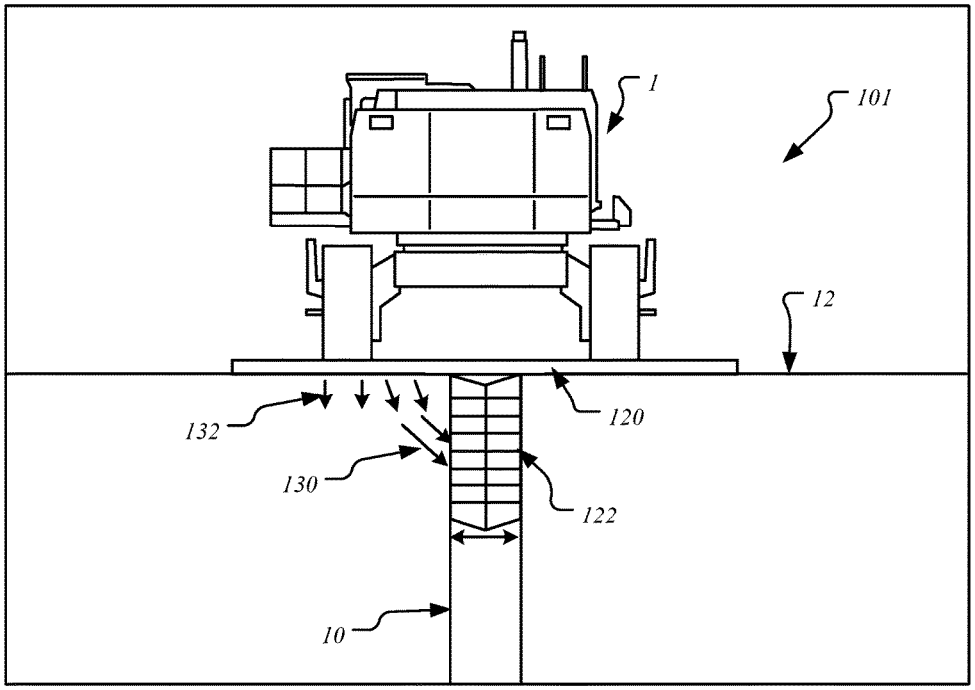
FIG. 11 shows an example trench support of the stabilizing system as it may be connected to the mat.

FIG. 11 shows an example trench support 122 of the stabilizing system 101 as it may be connected to the mat 120. It can be seen from the illustration, that sidewall pressure on the trench (indicated by arrows 130) due to pressure from the weight of the excavator 1 (indicated by arrows 132) is reduced by the mat 120 and/or trench support 122.

Figure 12:
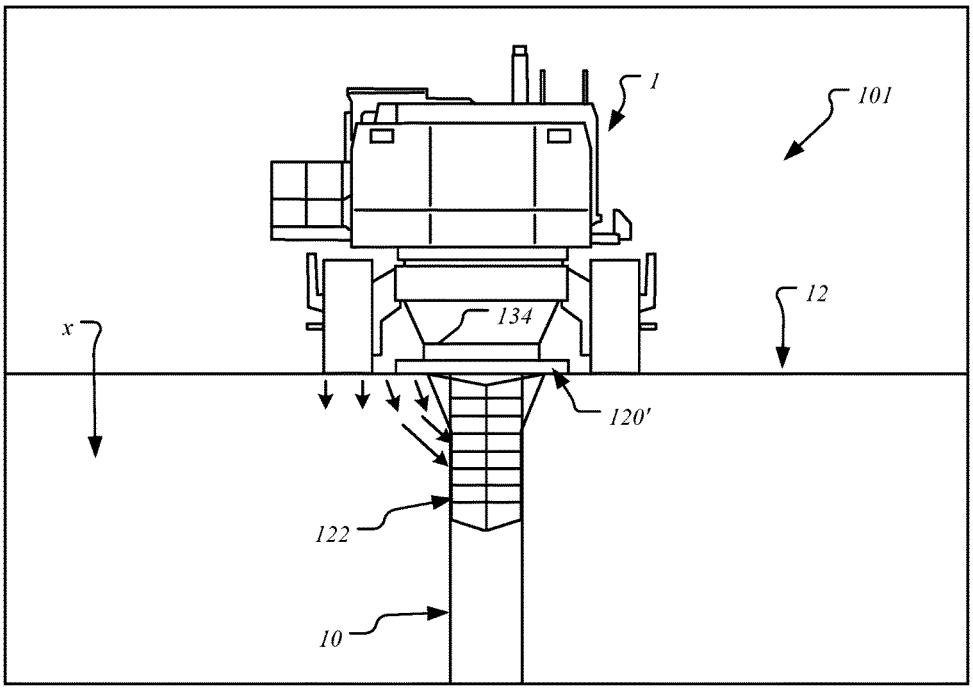
FIG. 12 shows the excavator with a lifting cable or arm configured to move the trench support of the stabilizing system.

FIG. 12 shows the excavator with a lifting cable or arm 134 configured to move the trench support 122 of the stabilizing system 101. It can be seen from the illustration, that sidewall pressure on the trench (indicated by arrows 130) due to pressure from the weight of the excavator 1 (indicated by arrows 132) is reduced by the mat 120 and/or trench support 122. It is noted that in this example, a smaller mat 120' is implemented, primarily as a hanger for the trench support 122.

Figure 13:
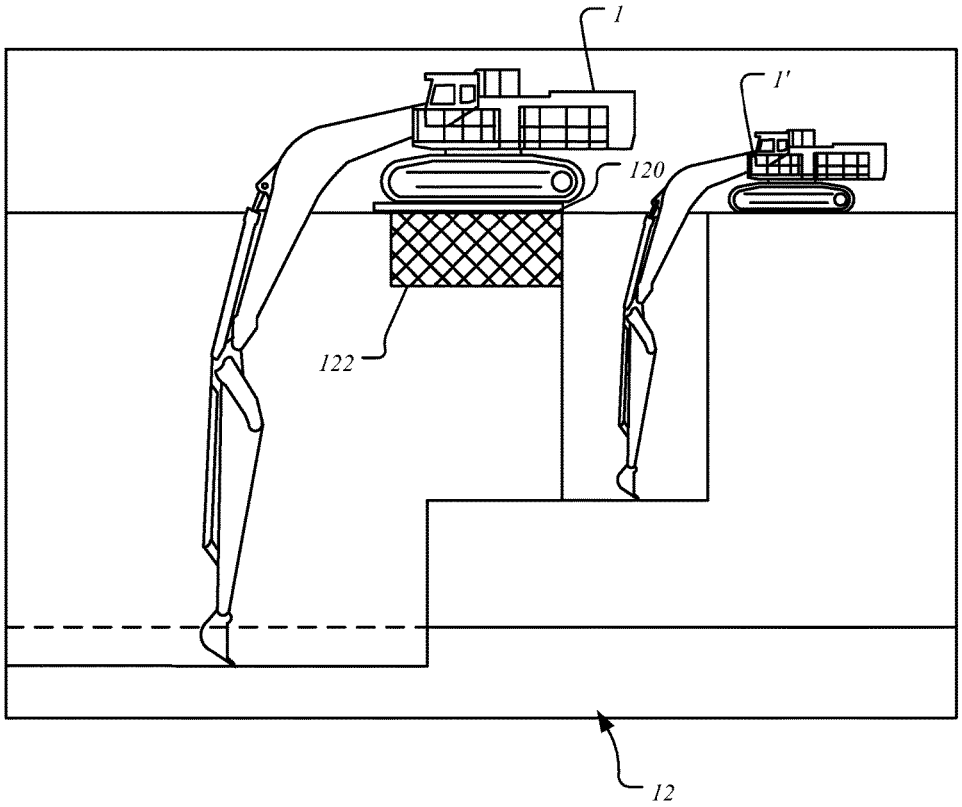
FIG. 13 illustrates excavators implementing a trench support of the stabilizing system to dig a slurry wall in the same heading.

FIG. 13 illustrates excavators implementing a mat 120 and a trench support 122 of the stabilizing system 101 to dig a slurry wall in the same heading. In an example, for Komatsu excavators or the like, a PC 800 excavator 1, and a PC 1250 excavator 1' (e.g., machines commonly used in the United States), can both operate simultaneously on the same trench by utilizing the stabilizing system 101.

The stabilizing system 101 enables a larger excavator 1 to operate while straddling an open trench and concentrate on the deeper depths. At the same time a smaller excavator 1' (e.g., operating at a fraction of the cost) can dig the shallower depths, thereby increasing production.

The stabilizing system 101 implemented for the larger excavator, while also enabling the smaller trenching excavator to work simultaneously, utilizes all equipment to its full potential and reduces project costs. For example, finishing a project faster results in cost savings related to hourly employees and all equipment for the job (e.g., excavators, dozers, pumps, pipes, office trailers de-sanding machines, inspectors, etc.).

By way of illustration, production can be increased (e.g., by 100% or more) without increasing the cost, other than the cost of the first pass excavator. The percent in increased production, translates to almost the same percentage cut in overall cost (the only constant, is the cost of bentonite, mixing the slurry, and the design).

In addition, the stabilizing system 101 may be implemented by both size excavators 1 and 1'. This reduces the acquisition cost for a contractor that has both sizes of excavators in their fleet. That is, a single extended track frame can be implemented that fits both excavators 1 and 1'. For example, an extended center frame 100 for a Komatsu PC 800 or the like will fit other PC 800's.

Figure 14:
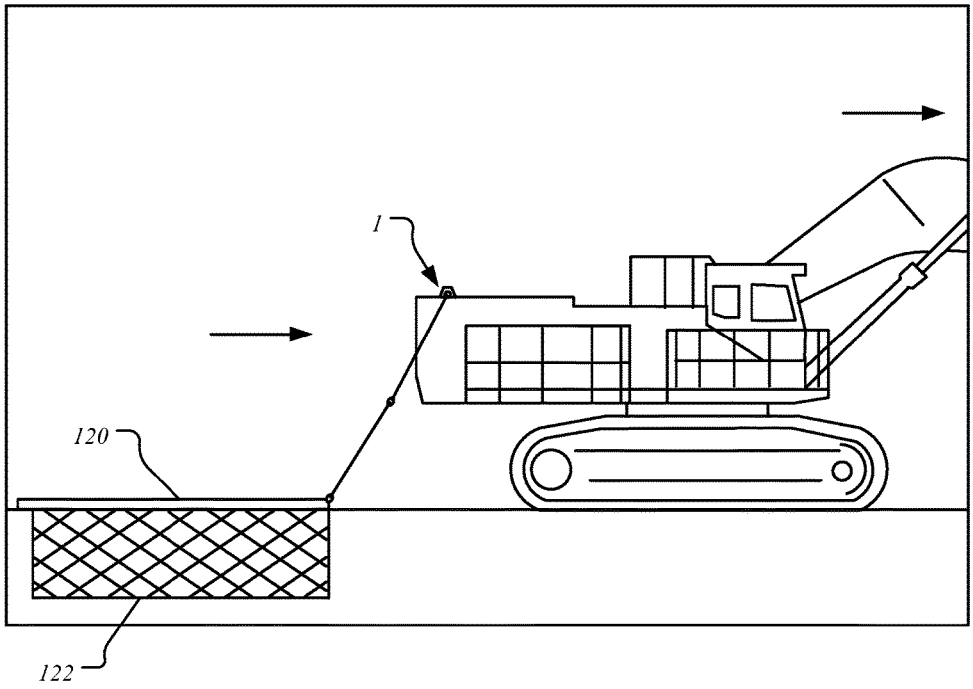
FIG. 14 shows an excavator re-positioning pads of the stabilizing system without having to lift the pads into position.

FIG. 14 shows an excavator re-positioning the pad 120 and support 122 of the stabilizing system 101 without having to lift the pads or support into position. The operations shown and described herein are provided to illustrate example implementations. It is noted that the operations are not limited to the ordering shown. Still other operations may also be implemented.

Figure 15:
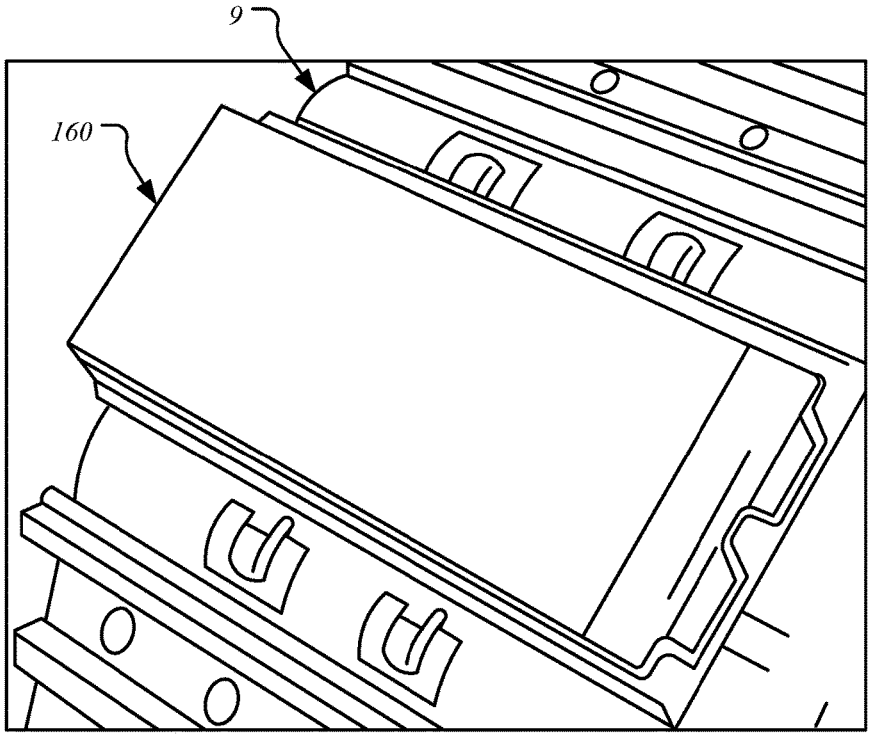
FIG. 15 illustrates an example of the stabilizing system implemented with pads.

FIG. 15 illustrates an example of the stabilizing system implemented with pads 160 (e.g., rubber/polyurethane). The pads 160 may be provided on the tracks 9 (e.g., tracks 9*a* and 9*b* in FIG. 4) of the excavator. The pads 160 may raise the tracks 9 from contact with the mat 120, thereby reducing or preventing damage to the mat 120.

It is noted that the examples shown and described are provided for purposes of illustration and are not intended to be limiting. Still other examples are also contemplated.

The invention claimed is:

1. A stabilizing system for an excavator, comprising:

an extended center frame having a frame component for mounting between opposing tracks of the excavator and a base portion of the excavator, the frame component extending beyond the base portion of the excavator on both sides to move the opposing tracks apart from one another;

a trench support: and a mat attached to the trench support by at least one pin and a channel, the at least one pin sliding in the channel so that the mat pivots.

2. The stabilizing system of claim 1, wherein the frame component is bolted onto the base portion of the excavator to widen a footprint of the excavator and reduce ground pressure.

3. The stabilizing system of claim 1, wherein the frame component is bolted onto the base portion of the excavator without having to make any other modification to the excavator.

4. The stabilizing system of claim 1, wherein the frame component is bolted onto a track frame for each of the opposing tracks.

5. The stabilizing system of claim 1, wherein the frame component provides a width between the opposing tracks measuring about 16 feet to about 28 feet.

6. The stabilizing system of claim 1, further comprising at least one stabilizer mounted to the frame component, the at least one stabilizer raising and lowering to redistribute weight of the excavator and further reduce ground pressure and stabilize the excavator.

7. The stabilizing system of claim 6, wherein the stabilizer includes at least one of rollers, casters, tracks and skids.

8. The stabilizing system of claim 6, wherein the stabilizer extends substantially parallel to the opposing tracks of the excavator.

9. The stabilizing system of claim 8, wherein the stabilizer extends for a same length as the opposing tracks of the excavator.

10. The stabilizing system of claim 9, wherein the stabilizer has a front end, the front end having a radius substantially the same as a radius of an adjacent one of the opposing tracks of the excavator.

11. The stabilizing system of claim 9, wherein the stabilizer has a back end, the back end having a radius substantially the same as a radius of an adjacent one of the opposing tracks of the excavator.

12. The stabilizing system of claim 1, wherein the trench support forms a plurality of voids for a slurry to pass through.

13. A stabilizing system for an excavator, comprising:

an extended center frame;

an extendable stabilizer; and a lift to raise and lower a mat below the excavator so that the mat stays with the excavator when the excavator moves; and wherein the mat is attached to a trench support by at least one pin and a channel, the at least one pin sliding in the channel so that the mat pivots.

14. A stabilizing system for an excavator, comprising:

an extended center frame;

an extendable stabilizer;

a trench support having a structure having a plurality of voids formed therein, wherein the structure of the trench support is substantially the same width as a bucket of the excavator, the structure of the trench support providing support of sidewalls of a trench dug by the bucket so as to maintain the sidewalls of the trench and prevent the sidewalls of the trench from collapsing under pressure of the excavator; and a mat attached to the trench support by at least one pin and a channel, the at least one pin sliding in the channel so that the mat pivots.

* * * * *